US010912381B2

(12) United States Patent
Yao

(10) Patent No.: US 10,912,381 B2
(45) Date of Patent: Feb. 9, 2021

(54) CABINET DOOR

(71) Applicant: Kohler (China) Investment Co. Ltd., Shanghai (CN)

(72) Inventor: Dewang Yao, Shanghai (CN)

(73) Assignee: KOHLER (CHINA) INVESTMENT CO., LTD, Shanghai (CN)

( * ) Notice: Subject to any disclaimer, the term of this patent is extended or adjusted under 35 U.S.C. 154(b) by 0 days.

(21) Appl. No.: 16/520,440

(22) Filed: Jul. 24, 2019

(65) Prior Publication Data

US 2020/0029689 A1 Jan. 30, 2020

(30) Foreign Application Priority Data

Jul. 24, 2018 (CN) ..... 2018 2 1174326 U

(51) Int. Cl.

| | |
|---|---|
| ***A47B 67/00*** | (2006.01) |
| ***A47G 1/02*** | (2006.01) |
| ***F21V 33/00*** | (2006.01) |
| *F21W 131/301* | (2006.01) |
| *F21W 131/302* | (2006.01) |

(52) U.S. Cl.

CPC ..... *A47B 67/005* (2013.01); *A47G 1/02* (2013.01); *F21V 33/004* (2013.01); *F21W 2131/301* (2013.01); *F21W 2131/302* (2013.01)

(58) Field of Classification Search

CPC ..... F21S 4/00; F21S 4/20; F21S 4/24; A48B 67/005; F21V 33/004

See application file for complete search history.

(56) References Cited

U.S. PATENT DOCUMENTS

| | | | | |
|---|---|---|---|---|
| 6,292,901 | B1 * | 9/2001 | Lys | H05B 47/18 713/300 |
| 10,578,352 | B2 * | 3/2020 | Kim | F25D 29/005 |
| 2009/0147504 | A1 * | 6/2009 | Teeters | F21S 2/005 362/153 |
| 2010/0296298 | A1 * | 11/2010 | Martin, Jr. | A47G 1/0622 362/311.06 |
| 2016/0032545 | A1 * | 2/2016 | Lumsden | F21S 4/20 404/6 |
| 2016/0047539 | A1 * | 2/2016 | Cano | F21V 23/02 362/133 |

(Continued)

*Primary Examiner* — Anabel Ton

(74) *Attorney, Agent, or Firm* — Lempia Summerfield Katz LLC

(57) ABSTRACT

A cabinet door includes a transparent cover plate, an outer frame secured with the transparent cover plate, and an inner frame arranged inside the outer frame and supporting the transparent cover plate that includes a reflecting region coated with a reflective coating and a light transmitting region surrounding the reflecting region; the light transmitting region includes a plurality of light transmitting edges annularly arranged around the reflecting region, and a light transmitting corner is formed between any two adjacent light transmitting edges. Each of first lamp strips is secured on the inner frame and arranged on the same sides as the respective light transmitting edges correspondingly. Each of second lamp strips is secured on the inner frame, one second lamp strip is arranged between any two adjacent first lamp strips, and the second lamp strips correspond to the respective light transmitting corners one by one.

20 Claims, 6 Drawing Sheets

(56) References Cited

U.S. PATENT DOCUMENTS

| | | | | |
|---|---|---|---|---|
| 2016/0069518 | A1* | 3/2016 | Steele | F21V 29/83 362/84 |
| 2016/0116118 | A1* | 4/2016 | Bernard | F21V 21/049 362/224 |
| 2018/0306971 | A1* | 10/2018 | Conrad | F21S 9/02 |
| 2019/0261788 | A1* | 8/2019 | Ringel | A47B 57/10 |

* cited by examiner

CABINET DOOR

CROSS-REFERENCE TO RELATED APPLICATION

This application claims priority benefit of Chinese Utility Model CN 201821174326.6 filed Jul. 24, 2018. The entire contents of which hereby incorporated by reference herein.

TECHNICAL FIELD

The disclosed embodiments relate to the field of furniture, and more particularly, to a cabinet door including illumination.

BACKGROUND

At present, a mirror is generally installed on a cabinet door of a cabinet placed in a bathroom or a bedroom for accommodating toiletries or cosmetics. Such a mirror in a bathroom or bedroom may be aided by lighting. However, when the lighting is mounted inconspicuously with respect to the cabinet, dark spots may result in the viewing area of the user.

SUMMARY

The following embodiments are intended to provide a cabinet door to avoid dark spots in light transmitting corners, which can further expand the applicability of the cabinet door.

In order to solve the technical problem above, the embodiments provide a cabinet door, which comprises: a transparent cover plate; an outer frame surrounding the transparent cover plate and secured with the transparent cover plate; and an inner frame arranged inside the outer frame, and used for supporting the transparent cover plate; wherein one side of the transparent cover plate facing the inner frame comprises a reflecting region coated with a reflective coating and a light transmitting region surrounding the reflecting region, the light transmitting region comprises N light transmitting edges annularly arranged around the reflecting region, N is a natural number greater than 3, and a light transmitting corner is formed between any two adjacent light transmitting edges; wherein, the cabinet door comprises: M first lamp strips, wherein M is equal to N, and there is a one-to-one correspondence between them; the first lamp strips are sequentially arranged along the inner frame, the first lamp strips are all secured on the inner frame and are arranged on the same sides as the respective light transmitting edges correspondingly, and the first lamp strips are all used for emitting lights towards the corresponding light transmitting edges respectively when the cabinet door is opened; and K second lamp strips, wherein K is equal to M, the second lamp strips are all secured on the inner frame, one second lamp strip is arranged between any two adjacent first lamp strips, all the second lamp strips correspond to the corresponding light transmitting corners respectively, and the second lamp strips are used for emitting lights towards the corresponding light transmitting corners respectively when the cabinet door is opened.

The cabinet door further comprises a plurality of second lamp strips, one second lamp strip is arranged between any two adjacent first lamp strips, all the second lamp strips correspond to the corresponding light transmitting corners respectively, and the second lamp strips can emit lights towards the corresponding light transmitting corners respectively when the cabinet door is opened, so that dark spots can be avoided in the light transmitting corners, which can further expand the applicability of the cabinet door.

Further, the inner frame comprises: a plurality of inner edges with a number same as that of the light transmitting edges, wherein the inner edges correspond to the light transmitting edges one by one, the inner edges are arranged on the same sides as the corresponding light transmitting edges; a plurality of corner edges with a number same as that of the light transmitting corners, one corner edge is arranged between any two adjacent inner edges, the corner edges correspond to the light transmitting corners one by one, and a normal direction of the corner edges points to the corresponding light transmitting corners respectively; and a plurality of enclosing edges, wherein at least two enclosing edges are respectively arranged at top parts of any two inner edges opposite to each other for bearing the transparent cover plate; wherein, one first lamp strip is provided on one side of each inner edge facing the outer frame, and one second lamp strip is provided on one side of each corner edge facing the outer frame.

Further, the first lamp strip comprises: a first substrate secured on one side of any of the inner edges facing the outer frame; and a plurality of first light sources arranged on the first substrate.

Because the first substrate is provided with a plurality of first light sources, the light transmitting corners can be fully illuminated by the plurality of first light sources.

Further, the first substrate is a hard plate or a soft plate.

Further, the second lamp strip comprises: a second substrate secured on one side of any of the corner edges facing the outer frame; and a plurality of second light sources arranged on the second substrate.

Further, the second substrate is a hard plate or a soft plate.

Further, the cabinet door further comprises: a main control unit electrically connected with each of the first lamp strips and each of the second lamp strips; and a first touch control key arranged in the transparent cover plate and electrically connected with the main control unit for sending a first touch control signal to the main control unit; wherein, the main control unit is configured to turn on or turn off each of the first lamp strips and each of the second lamp strips after receiving the first touch control signal sent by the first touch control key.

Further, the cabinet door further comprises: a second touch control key arranged in the transparent cover plate and electrically connected with the main control unit for sending a second touch control signal to the main control unit; and wherein, the main control unit is further configured to adjust a brightness of each of the first lamp strips and each of the second lamp strips after receiving the second touch control signal sent by the second touch control key.

Further, the cabinet door further comprises: a third touch control key arranged in the transparent cover plate and electrically connected with the main control unit for sending a third touch control signal to the main control unit; wherein, the main control unit is further configured to adjust a color temperature of each of the first lamp strips and each of the second lamp strips after receiving the third touch control signal sent by the third touch control key.

Further, the cabinet door further comprises: a sensor electrically connected with the main control unit for detecting a human body in a preset range; and wherein, the main control unit is configured to turn on each of the first lamp strips and each of the second lamp strips when the sensor detects the human body.

DETAILED DESCRIPTION

A cabinet door may comprise a glass cover plate, an outer frame for securing the glass cover plate and an inner frame arranged inside the outer frame and used for supporting the glass cover plate. One side of the glass cover plate facing the inner frame comprises: a reflecting region coated with a reflective coating and a light transmitting region surrounding the reflecting region, and the light transmitting region comprises: a plurality of light transmitting edges annularly arranged around the reflecting region, a light transmitting corner is formed between adjacent light transmitting edges, and meanwhile, the cabinet door further comprises: a plurality of first lamp strips sequentially and annularly arranged on the inner frame, the number of the first lamp strips is equal to the number of the light transmitting edges. That is to say, each of the light transmitting edges is provided with one first lamp strip, and the first lamp strips are connected end to end. The inventor finds that at least the following problems exist in the prior art: two first lamp strips are generally connected at a light transmitting corner, and the mirror is generally quadrangular. In other words, two first lamp strips are connected at an included angle of 90°. Therefore, a plurality of lamps cannot be generally arranged at a joint of two first lamp strips, so that illumination at the light transmitting corners is insufficient. That is, dark spots might be formed at the light transmitting corners, which further reduces the applicability of the cabinet door.

Figure 1:
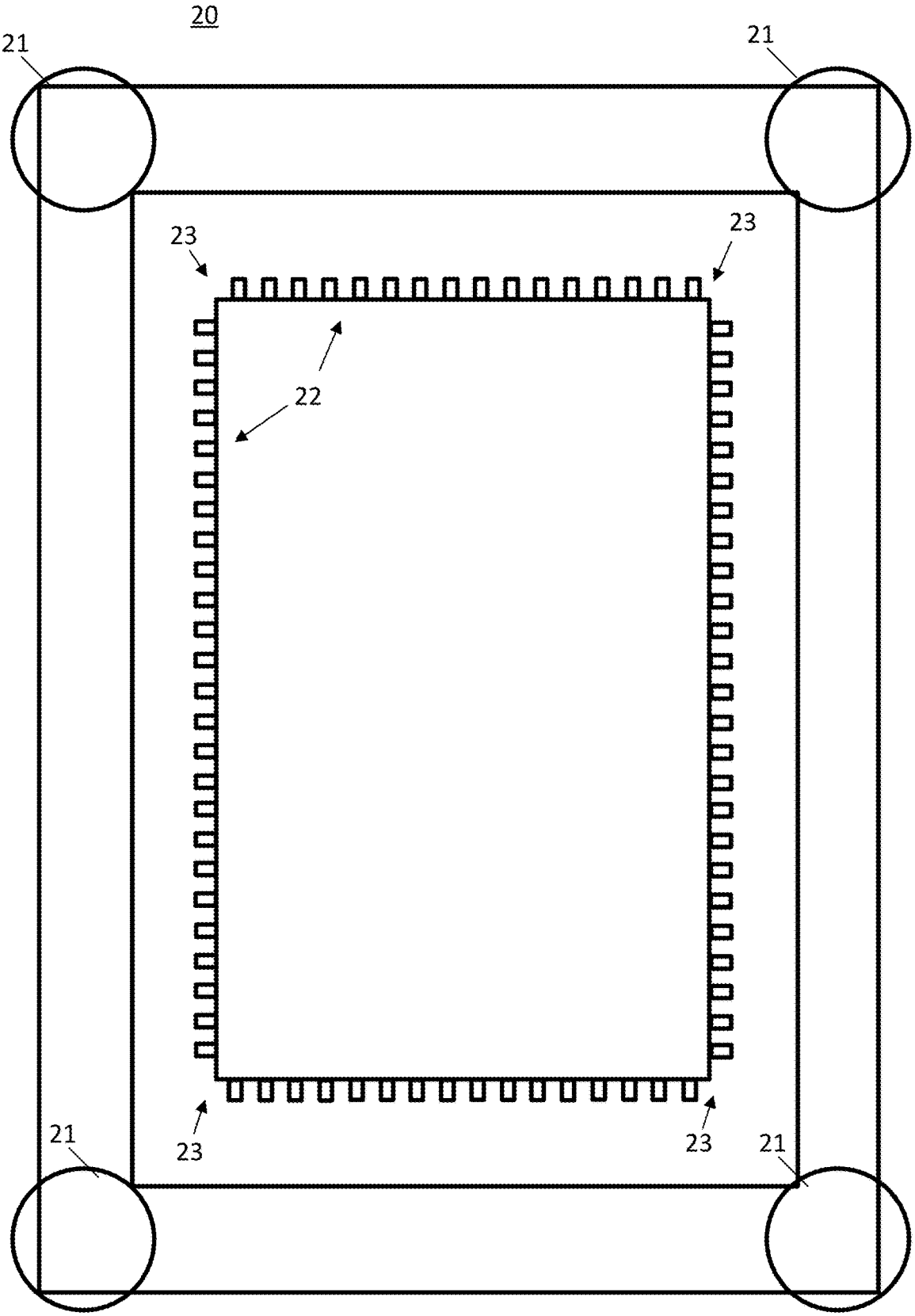
FIG. 1 is an example of an example illuminated cabinet with dark areas.

FIG. 1 illustrates an example cabinet structure 20 having an assembly 22 of light strips. The assembly 22 of light strips may be arranged to have a space 23 formed where the two intersected sides of light strips that corresponds to a dark region 21. This is because at the corner area formed by two intersected sides of the mirror, the farthest distance from the lamp strips to the outer frame is as far as the diagonal line of the quadrangle formed by the two intersectional outer frame sides and two intersectional lamp strips. Therefore, it can be seen that the distance for the illumination of the corner area is too long and only a limited part of light emitted by the lamp strips may reach the dark region 21, so the dark spots are formed accordingly. The space 23 between the intersected side of light strips may be very small, and even in this case, the distance for lighting up the whole outside corner area is too far and the light cannot reach adequately resulting in dark region 21.

In order to make the objects, technical solutions and advantages of the following embodiments clearer, the embodiments are described in detail hereinafter with reference to the drawings. However, those of ordinary skills in the art may understand that a lot of technical details are proposed in all the embodiments in order to make the readers better understand the present application. However, the technical solutions sought to be protected by the claims of the present application can also be realized even without these technical details as well as various changes and amendments based on the following embodiments.

Figure 2:
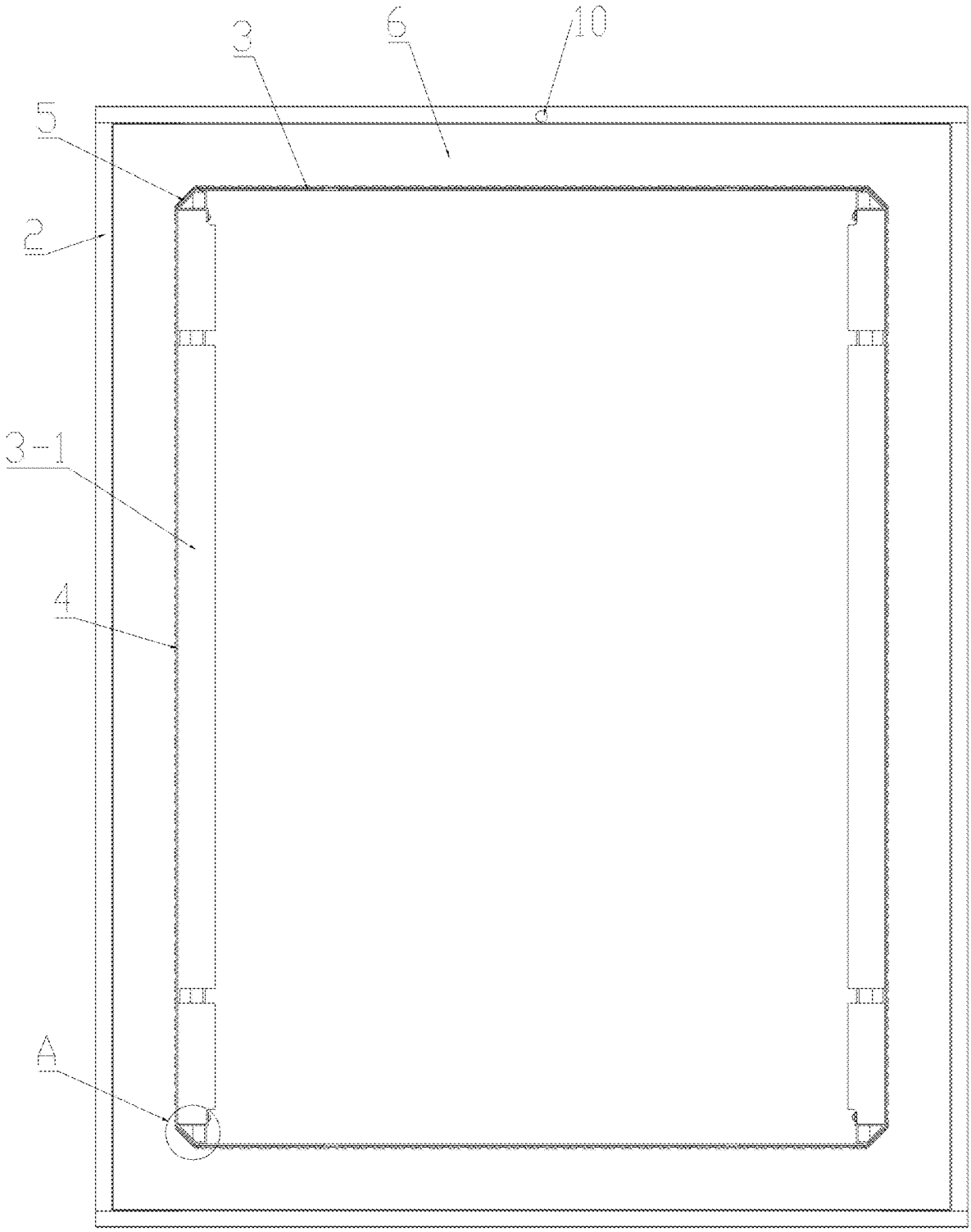
FIG. 2 is a structure diagram of a cabinet door after removing a transparent cover plate in a first embodiment.
Figure 3:
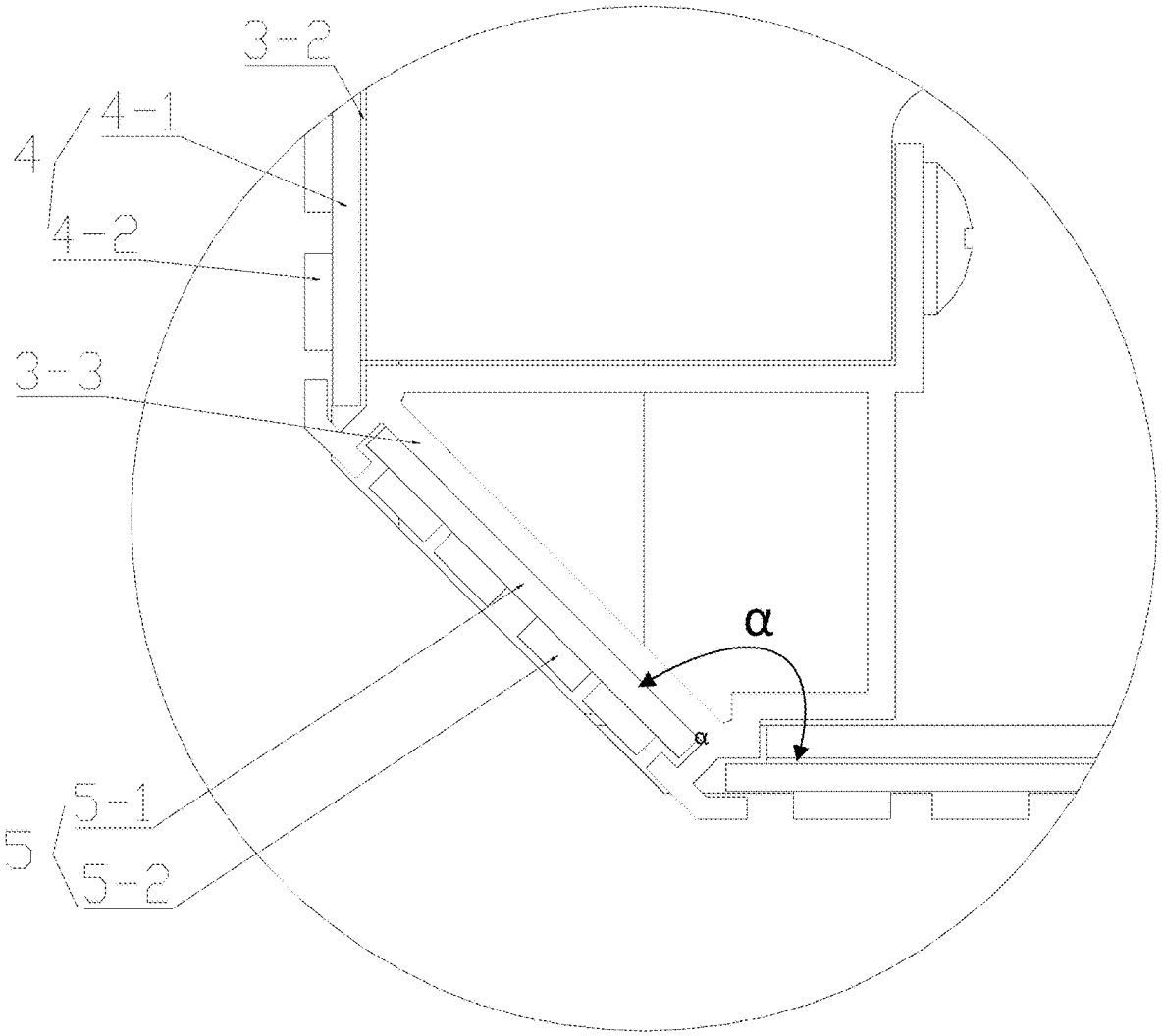
FIG. 3 is an enlarged diagram of part A in FIG. 1.
Figure 4:
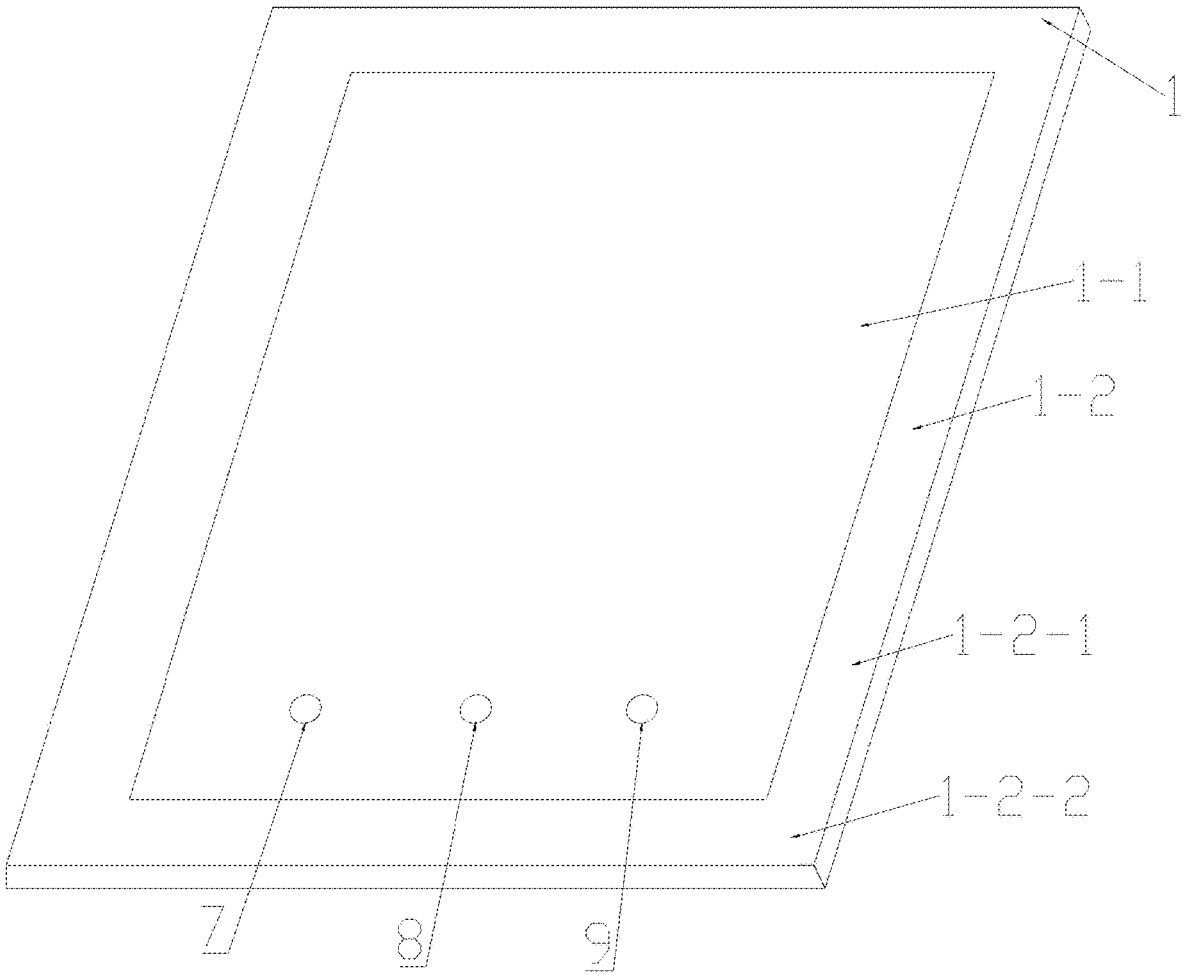
FIG. 4 is a structure diagram of the transparent cover plate in the first embodiment.

A first embodiment relates to a cabinet door. As shown in FIG. 2 to FIG. 4, the cabinet door comprises a transparent cover plate 1, an outer frame 2 surrounding the transparent cover plate 1, and an inner frame 3 arranged inside the outer frame 2. The transparent cover plate 1 can be a transparent plate such as a glass plate or a crystal plate, and the outer frame 2 is secured with the transparent cover plate 1. For example, the transparent cover plate 1 can be attached to the outer frame 2 through glue, or one side of the transparent cover plate 1 can be embedded into the outer frame 2. Meanwhile, in order to secure the transparent cover plate 1, the inner frame 3 is also used for supporting the transparent cover plate 1. One side of the transparent cover plate 1 facing the inner frame 3 comprises a reflecting region 1-1 coated with a reflective coating and a light transmitting region 1-2 surrounding the reflecting region 1-1. The light transmitting region 1-2 comprises a plurality of light transmitting edges 1-2-1 annularly arranged around the reflecting region 1-1, and a light transmitting corner 1-2-2 is formed between any two adjacent light transmitting edges 1-2-1.

In addition, the cabinet door further comprises a plurality of first lamp strips 4 and a plurality of second lamp strips 5. The number of the first lamp strips 4 may be equal to the number of the light transmitting edges 1-2-1, and the first lamp strips 4 correspond to the light transmitting edges 1-2-1 (e.g., correspond on a one by one basis). Each of the first lamp strips 4 may be sequentially arranged along the inner frame 3, and each of the first lamp strips 4 may be secured on the inner frame 3 and arranged on the same side as the respective light transmitting edge 1-2-1 correspondingly. Each of the first lamp strips 4 emits lights towards the corresponding light transmitting edge 1-2-1 respectively when the cabinet door is opened, which may be detected by a sensor described in more detail below.

The lights (e.g., first lamp strips 4 and second lamp strips 5) may be turned on in response to an input signal and/or turned off in response to the absence of the input signal or in response to a cessation signal. The input signal may be generated in response to sensor data, for example, when a proximity sensor or an infrared signal indicates that a user or other entity or object is within a predetermined distance to the cabinet. The input signal from the sensor data is sent to a controller that is configured to turn on and off the lights. In the alternative or in addition, the lights may be turned on and off in response to a user input to (e.g., touch input) received at the lower area (i.e. the area where reference numbers 7, 8, 9 are indicated), a turning on signal is sensed by capacitive sensors and sent to the controller for turning on/off the lights.

The number of the second lamp strips 5 is equal to the number of the first lamp strips 4, and each of the second lamp strips 5 is secured on the inner frame 3. One second lamp strip 5 is arranged between any two adjacent first lamp strips 4, and all the second lamp strips 5 correspond to the respective light transmitting corners 1-2-2 one by one. Each of the second lamp strips 5 emits lights towards the corresponding light transmitting corner 1-2-2 respectively when the cabinet door is opened.

The cabinet door further comprises a plurality of second lamp strips 5, one second lamp strip 5 is arranged between any two adjacent first lamp strips 4, and each of the second lamp strips 5 corresponds to the corresponding light transmitting corner 1-2-2 respectively, and each of the second lamp strips 5 can emit lights towards the corresponding light transmitting corner 1-2-2 respectively when the cabinet door is opened, so that dark spots can be avoided in the light transmitting corners 1-2-2, which can further expand the applicability of the cabinet door.

Specifically, as shown in FIG. 2, the cabinet door further comprises a base plate 6. The base plate 6 is securely connected with the inner frame 3 and the outer frame 2. As shown in FIG. 2 and FIG. 3, the inner frame 3 above comprises a plurality of enclosing edges 3-1, a plurality of inner edges 3-2 all arranged on the base plate 6, and a plurality of corner edges 3-3. The inner edges 3-2 and the corner edges 3-3 are all integrally formed with the base plate 6, wherein the number of the inner edges 3-2 is the same as that of the light transmitting edges 1-2-1, and the inner edges 3-2 correspond to the light transmitting edges 1-2-1 one by one. Each of the inner edges 3-2 is arranged on the same side as the corresponding light transmitting edge 1-2-1, each of the inner edges 3-2 is provided with one first lamp strip 4, and the first lamp strip 4 is located on the side of the inner edge 3-2 facing the outer frame 2. The number of the corner edges 3-3 is the same as that of the light transmitting corners 1-2-2, and the corner edges 3-3 correspond to the light transmitting corners 1-2-2 one by one. One corner edge 3-3 is arranged between any two adjacent inner edges 3-2, a normal direction of the corner edges 3-3 points to the corresponding light transmitting corners 1-2-2 respectively, each of the corner edges 3-3 is provided with one second lamp strip 5, and the second lamp strip 5 is located on the side of the inner frame 3 facing the outer frame 2. Meanwhile, in order to support the transparent cover plate 1, at least two enclosing edges 3-1 are respectively arranged at top parts of any two inner edges 3-2 opposite to each other, and the enclosing edges 3-1 can be integrally formed with the inner edges 3-2. Specifically, in the embodiment, as shown in FIG. 2, four inner edges 3-2, four corner edges 3-3, four corresponding first lamp strips 4 and four corresponding second lamp strips 5 are arranged, the light transmitting region 1-2 is a quadrangular frame body, and each light transmitting edge 1-2-1 is one side of the quadrangular frame body. Certainly, in actual situations, a plurality of inner edges 3-2, a plurality of corner edges 3-3, a plurality of first lamp strips 4 and a plurality of second lamp strips 5 can be arranged, the number is not limited here.

In one example, the cabinet door is assembled in a predetermined order of steps or sequence. For example, enclosing edge 3-1 may be secured, then a corner edge 3-3 is secured to the enclosing edge 3-1 via a screw as shown in FIG. 2 together with FIG. 3. Then the process may be repeated at the opposite side.

Moreover, it should be noted that, when the transparent cover plate 1 is installed on the outer frame 2 and the inner frame 3, the reflecting region 1-1 of the transparent cover plate 1 completely covers the inner frame 3 and the first light strips 4 and the second light strips 5 on the inner frame 3, so that a user cannot view the first light strips 4 and the second light strips 5 through the light transmitting region 1-2.

In addition, specifically, as shown in FIG. 3, the first light strip 4 comprises a first substrate 4-1 secured on the side of the inner edge 3-2 facing the outer frame 2 and a plurality of first light sources 4-2 arranged on the first substrate 4-1. The second light source 5-2 may be highlight light emitting diode (LED) beads having a high brightness compared to the first light source 4-2, which may include LED beads having an ordinary or low brightness. The first light sources 4-2 are located on the side of the first substrate 4-1 facing the outer frame 2, and meanwhile, in order to secure the first light sources 4-2 as many as possible, the first substrate 4-1 can optionally be a hard plate. Certainly, in actual situations, the first substrate 4-1 can also be a soft plate, and the first substrate 4-1 can be attached to the inner edge 3-2 by glue. The hard plate is harder than the soft plate and the soft plate is softer than the hard place. The hard plate may include glass fiber epoxy coated copper plate (e.g., FR4 plate, which is a predetermined grade designation for glass-reinforced epoxy laminate material and may be formed of a composite material composed of woven fiberglass cloth with an epoxy resin binder that is flame resistant), and aluminum plate. One example for the soft plate is: flexible printed circuit board (FPC). The lights of the first light source 4-2 may be arranged in a line in a first direction and the lights of the second light source 5-2 may be arranged in a line in a second direction. The first direction may be at an angle to the second direction. The angle between the first direction and the second direction may be an obtuse angle (a), as shown in FIG. 3.

In addition, specifically, as shown in FIG. 3, the second light strip 5 comprises a second substrate 5-1 secured on the side of the corner edge 3-3 towards the outer frame 2 and a plurality of second light sources 5-2 arranged on the second substrate 5-1. The second light sources 5-2 are located on the side of the second substrate 5-1 towards the outer frame 2. Meanwhile, in order to secure the second light sources 5-2 as many as possible, the second substrate 5-1 can optionally be a hard plate. Certainly, in actual situations, the second substrate 5-1 can also be a soft plate, and the second substrate 5-1 can be attached to the corner edge 3-3 by glue. The hard plate may include glass fiber epoxy coated copper plate (e.g., FR4 plate) or aluminum plate, and the soft plate may be an FPC.

In addition, specifically, as shown in FIG. 4, the cabinet door further comprises a main control unit 100 electrically connected with each of the first lamp strips 4 and each of the second lamp strips 5 and a first touch control key 7 arranged in the transparent cover plate 1. The controller (e.g., main control unit 100) is arranged at the rear side of the mirror, and may be sandwiched between the cover plate 1 and the base plate 6. The main control unit 100 may be supported in a positioned spaced apart from the light transmitting region 1-2. The main control unit 100 is located inside the cabinet door. The main control unit 100 provides power to all the lights simultaneously, and it also controls the brightness as well as color temperature of all the lights.

The first touch control key 7 is electrically connected with the main control unit 100 for sending a first touch control signal to the main control unit 100. When the user touches the first touch control key 7, the first touch control key 7 sends the first touch control signal to the main control unit 100, and the main control unit 100 turns on or turns off each of the first lamp strips 4 and each of the second lamp strips 5 after receiving the first touch control signal sent by the first touch control key 7.

Meanwhile, the cabinet door further comprises a second touch control key 8 arranged in the transparent cover plate 1. The second touch control key 8 is electrically connected with the main control unit 100 for sending a second touch control signal to the main control unit 100. When the user touches the second touch control key 8, the second touch control key 8 sends the second touch control signal to the main control unit 100, and the main control unit 100 adjusts a brightness of each of the first lamp strips 4 and each of the second lamp strips 5 after receiving the second touch control signal.

Meanwhile, the cabinet door further comprises a third touch control key 9 arranged in the transparent cover plate 1. The third touch control key 9 is electrically connected with the main control unit 100 for sending a third touch control signal to the main control unit 100. When the user touches the third touch control key 9, the third touch control key 9 sends the third touch control signal to the main control unit 100, and the main control unit 100 adjusts a color temperature of each of the first lamp strips 4 and each of the second lamp strips 5 after receiving the third touch control signal.

In addition, as shown in FIG. 2, the cabinet door further comprises a sensor 10 electrically connected with the main control unit 100. The sensor 10 is an infrared sensor 10, and the sensor 10 is arranged on the outer frame 2. Certainly, in actual situations, the sensor 10 can also be arranged on other structural members on which the cabinet door is installed, such as a cabinet body, or the sensor 10 is arranged on a wall near the cabinet body. The sensor 10 can detect a human body in a preset range, such as within one meter from the cabinet door. When the sensor 10 detects the human body, a turn-on signal is sent to a main control system. After the main control unit 100 receives the turn-on signal, each of the first lamp strips and each of the second lamp strips are turned on, so that the lamp is turned on once a person approaches the cabinet door, and the lamp is turned off once the person leaves the cabinet door. Certainly, the lamp can be set to be turned off after a preset time.

Figure 5:
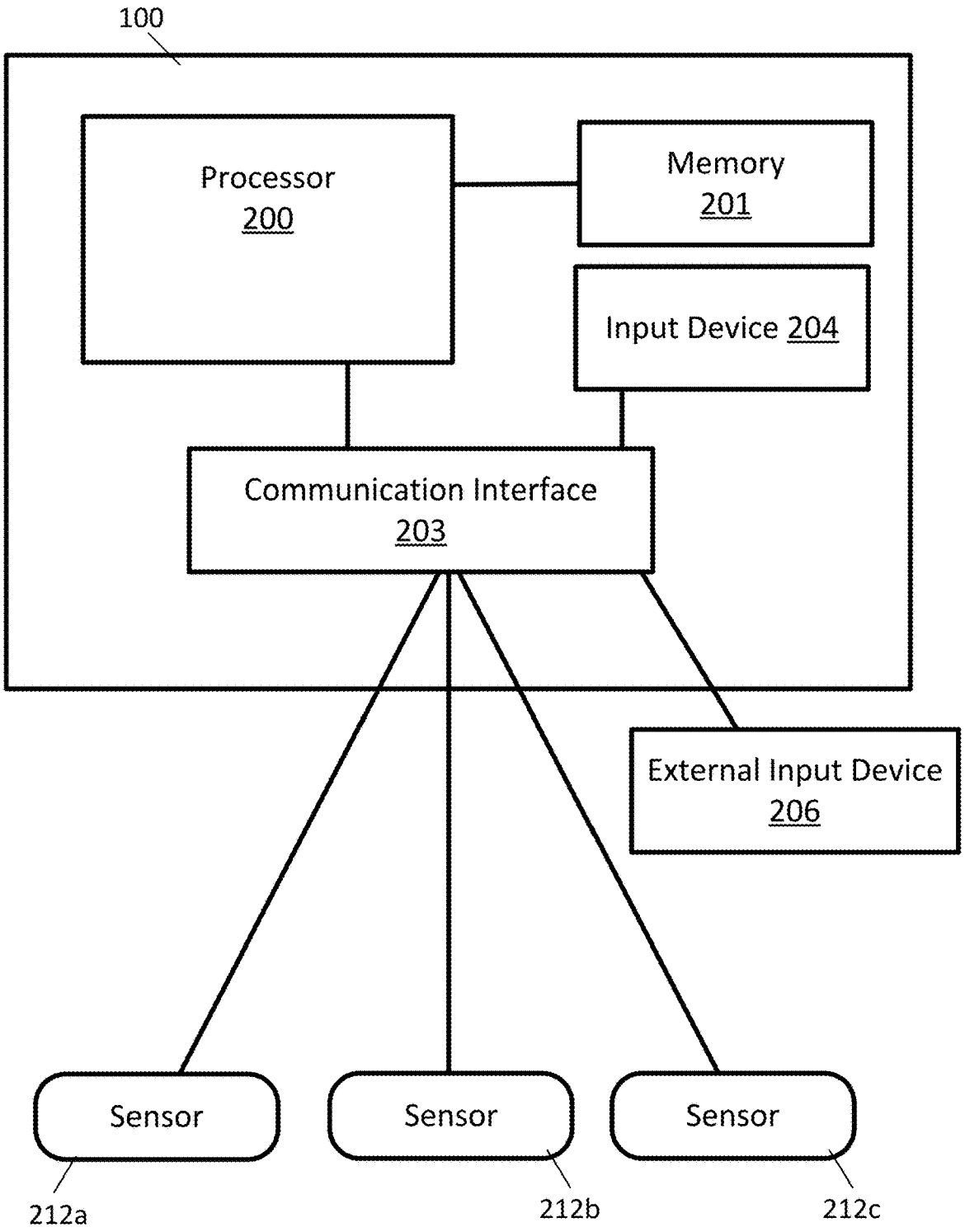
FIG. 5 is an example controller.

FIG. 5 illustrates a controller 100. The controller 100 may include a processor 200, a memory 201, an input device 204, and a communication interface 203. The communication interface 203 may communicate with one or more sensors such as sensor 212*a*, sensor 212*b*, and sensor 212*c* and/or an external input device 206. Additional, different, or fewer components may be included.

In one example, one or more of sensors 212*a-c* are capacitive sensors that detect a touch onto the surface of the mirror. The sensors 212*a-c* may be associated with a grid overlaid on the mirror that defines one or more gradients for corresponding to different parameters. Touch inputs along the gradients define settings for the one or more parameters. Example parameters include brightness, color, temperature, and a time interval. The areas of the gradients for the sensors 212*a-c* may be defined according to a user input from the input device 204 or the external input device 206.

One or more of the sensors 212*a-c* may correspond to sensor 10 for detection of a user, object, or human in the vicinity of the sensors 212*a-c*. The of the sensors 212*a-c* may be an infrared sensor, laser, ultrasonic sensor, or microphone that detects the user, object, or human. A range for the sensors 212*a-c* from the mirror may be defined according to a user input from the input device 204 or the external input device 206. In one example, the sensors 212*a-c* include multiple sensors that are selected according to a user input from the input device 204 or the external input device 206. For example, the user may select whether the infrared sensor, laser, ultrasonic sensor, or microphone are used to detect the proximity of the mirror. Additional, or different sensors may be used.

In one example, one or more of sensors 212*a-c* are door sensors that determine whether the door of the cabinet is currently in an open state. The door sensor may be a pressure sensor, a line of sight sensor, or a motion sensor. The lights may be illuminated in response to the detection of the door sensor that the door in in an open state.

The external input device 206 may be a mobile device, a server, or a laptop computer in communication with the controller 100 in order to provide user inputs described above. The external input device 206 may be a sensor associated with another device or appliance (e.g., proximity sensor associated with a sink, a toilet, a shower, or other device).

Figure 6:
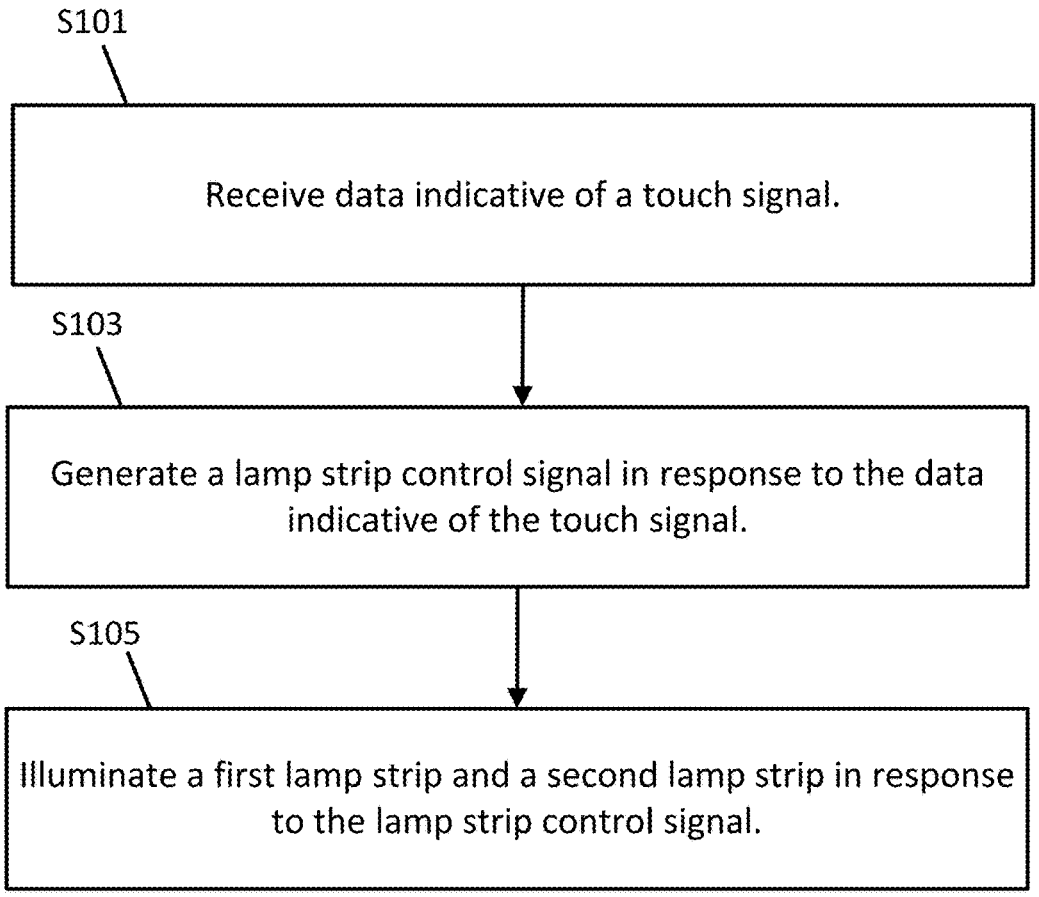
FIG. 6 is an example flowchart for the operation of the controller of FIG. 5.

FIG. 6 illustrates an example flowchart for operation of the controller 100 of FIG. 5 for illumination of a cabinet door including an outer frame and an inner frame arranged inside the outer frame. Additional, different, or fewer acts may be included.

At act S101, the controller 100 or the communication interface 203 is configured to receive data indicative of a first touch control signal from a first touch control key. The data may define one or more parameters for a first lamp strip and a second lamp strip described herein such as light sources 4-2 and light sources 5-2, respectively. The lights sources may be arranged along the inner frame at a predetermined angle that is greater than 90 degrees.

At act S103, the controller 100 is configured to generate a lamp strip control signal in response to the first touch control signal. The lamp strip control signal may include multiple aspects for illuminating the first and second lamp strips. The lamp strip control signal may include a lamp strip identifier that identifies which lamp strips are to be illuminated. The lamp strip control signal may indicate that all lamp strips along the inner frame are illuminated. The lamp strip control signal may define a time interval for each lamp strip that is to be illuminated. That is each lamp identifier may be associate with a time interval (e.g., start time and stop time and/or duration) that the lamp strip is to be illuminated. The time duration may be measured against the time of the touch signal. The time interval may depend on the time of day, day of week, day of the year. The time interval may depend on a user input received by the user input 205 or the external input device 206. The lamp strip control signal may include a brightness setting associated with each lamp strip identifier. The lamp strip control signal may include a color setting associated with each lamp strip identifier. The lamp strip control signal may include a temperature setting associated with each lamp strip identifier.

At act S105, the controller 100 is configured to illuminate a first lamp strip and a second lamp strip in a light transmitting region in response to the lamp strip control signal. Thus, the first lamp strip and the second lamp strip may be illuminated according to the lamp strip identifiers, time intervals, brightness settings, color settings, temperature settings, or other parameters set in the lamp strip control signal. In this manner, the controller 100 is configured to receive a second touch control signal from a second touch control key and adjust a brightness of each of the second lamp strips in response to the second touch control signal sent by the second touch control key. Further, the controller 100 is configured to receive a third touch control signal from a third touch control key and adjust a color temperature of each of the second lamp strips after receiving the third touch control signal sent by the third touch control key.

In one example, the first lamp strips are illuminated at a different time than the second lamp strips. A first time interval for the first lamp strip may be different than a second time interval for the second lamp strip.

In another examples, the first lamp strips are illuminated at a different brightness, temperature or color than the second lamp strips. A first setting for the first lamp strip is different than a second setting for the second lamp strip. In addition, the second lamp strip may be controlled in response to or as a function of the settings for the first lamp strip. For example, the second lamp strip may be turned on only when the first lamp strip setting is above a threshold brightness, temperature, or color. Similarly, the second lamp strip may be turned only with the time duration for the first lamp strip is greater than a time threshold.

In this manner, the controller 100 is configured to receive a second touch control signal from a second touch control key and adjust a brightness of each of the first lamp strips in response to the second touch control signal sent by the second touch control key and also adjust the second lamp strips to turn on the second lamp strips in response to the second touch control signal. Further, the controller 100 is configured to receive a third touch control signal from a third touch control key and adjust a color temperature of each of the first lamp strips after receiving the third touch control signal sent by the third touch control key and adjust the second lamp strips to turn on the second lamp strips in response to the second touch control signal.

The phrases "coupled with" or "coupled to" include directly connected to or indirectly connected through one or more intermediate components. Additional, different, or fewer components may be provided. Additional, different, or fewer components may be included.

The processor 200 may include a general processor, digital signal processor, an application specific integrated circuit (ASIC), field programmable gate array (FPGA), analog circuit, digital circuit, combinations thereof, or other now known or later developed processor. The processor 200 may be a single device or combinations of devices, such as associated with a network, distributed processing, or cloud computing.

The memory 201 may be a volatile memory or a non-volatile memory. The memory 201 may include one or more of a read only memory (ROM), random access memory (RAM), a flash memory, an electronic erasable program read only memory (EEPROM), or other type of memory. The memory 201 may be removable from the network device, such as a secure digital (SD) memory card.

In addition to ingress ports and egress ports, the communication interface 203 may include any operable connection. An operable connection may be one in which signals, physical communications, and/or logical communications may be sent and/or received. An operable connection may include a physical interface, an electrical interface, and/or a data interface.

The communication interface 203 may be connected to a network. The network may include wired networks (e.g., Ethernet), wireless networks, or combinations thereof. The wireless network may be a cellular telephone network, an 802.11, 802.16, 802.20, or WiMax network. Further, the network may be a public network, such as the Internet, a private network, such as an intranet, or combinations thereof, and may utilize a variety of networking protocols now available or later developed including, but not limited to TCP/IP based networking protocols.

The input device 204 may include a button, a switch, a keypad, a touchscreen, a key, an ignition, or other structure configured to allow a user to enter data or provide a command to operate the engine. The input device 204 may include a connection to a network, a smartphone, a tablet, a personal computer configured to electronically transmit the command to the engine. The communication may be wireless or wired (e.g., received by the communication interface 203).

While the computer-readable medium (e.g., memory 201) is shown to be a single medium, the term "computer-readable medium" includes a single medium or multiple media, such as a centralized or distributed database, and/or associated caches and servers that store one or more sets of instructions. The term "computer-readable medium" shall also include any medium that can store, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Processors suitable for the execution of a computer program include, by way of example, both general and special purpose microprocessors, and anyone or more processors of any kind of digital computer. Generally, a processor may receive instructions and data from a read only memory or a random access memory or both. The essential elements of a computer are a processor for performing instructions and one or more memory devices for storing instructions and data. Generally, a computer may also include, or be operatively coupled to receive data from or transfer data to, or both, one or more mass storage devices for storing data, e.g., magnetic, magneto optical disks, or optical disks. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention. Those of ordinary skills in the art may understand that the embodiments above are detailed embodiments, and in actual application, various amendments can be made in forms and details without deviating from the spirit and scope of the disclosure.

We claim:

1. A cabinet door, comprising:

a transparent cover plate;

an outer frame surrounding the transparent cover plate and secured with the transparent cover plate; and an inner frame arranged inside the outer frame and used for supporting the transparent cover plate; wherein one side of the transparent cover plate faces the inner frame, the transparent cover plate comprises a reflecting region coated with a reflective coating and a light transmitting region surrounding the reflecting region, the light transmitting region comprises N light transmitting edges annularly arranged around the reflecting region, N is a natural number greater than 3, and a light transmitting corner is formed between any two adjacent light transmitting edges; wherein, the cabinet door comprises:

M first lamp strips, wherein M is equal to N, and the M first lamp strips are corresponding to the N light transmitting edges one by one; each of the first lamp strips is sequentially arranged along the inner frame, each of the first lamp strips is secured on the inner frame and is arranged on the same side as the respective light transmitting edge correspondingly, and each of the first lamp strips includes a first substrate that faces the outer frame and at least one first light source that emits light towards the corresponding light transmitting edge of the transparent cover plate when the cabinet door is opened; and K second lamp strips, wherein K is equal to M, each of the second lamp strips is secured on the inner frame, one second lamp strip is arranged between any two adjacent first lamp strips, each of the second lamp strips corresponds to the corresponding light transmitting corner respectively, and each of the second lamp strips includes a second substrate that faces the outer frame and at least one second light source that emits light towards the corresponding corner respectively when the cabinet door is opened.

2. The cabinet door according to claim 1, wherein the inner frame comprises:

a plurality of inner edges with a number same as that of the light transmitting edges, wherein the inner edges correspond to the light transmitting edges one by one, each of the inner edges is arranged on the same side as the corresponding light transmitting edge;

a plurality of corner edges with a number same as that of the light transmitting corners, one corner edge is arranged between any two adjacent inner edges, the corner edges correspond to the light transmitting corners one by one, and a normal direction of each of the corner edges points to the corresponding light transmitting corner respectively; and a plurality of enclosing edges, wherein at least two enclosing edges are respectively arranged at top parts of any two inner edges opposite to each other for supporting the transparent cover plate;

wherein, one first lamp strip is provided on one side of each of the inner edges facing the outer frame, and one second lamp strip is provided on one side of each of the corner edges facing the outer frame.

3. The cabinet door according to claim 2, wherein the first lamp strip comprises:

a first substrate secured on one side of any of the inner edges facing the outer frame; and a plurality of first light sources arranged on the first substrate.

4. The cabinet door according to claim 3, wherein the first substrate is a hard plate or a soft plate.

5. The cabinet door according to claim 2, wherein the second lamp strip comprises:

a second substrate secured on one side of any of the corner edges facing the outer frame; and a plurality of second light sources arranged on the second substrate.

6. The cabinet door according to claim 5, wherein the second substrate is a hard plate or a soft plate.

7. The cabinet door according to claim 5, wherein the cabinet door further comprises:

a main control unit electrically connected with each of the first lamp strips and each of the second lamp strips; and a first touch control key arranged in the transparent cover plate and electrically connected with the main control unit for sending a first touch control signal to the main control unit;

wherein, the main control unit is configured to turn on or turn off each of the first lamp strips and each of the second lamp strips after receiving the first touch control signal sent by the first touch control key.

8. The cabinet door according to claim 7, wherein the cabinet door further comprises:

a second touch control key arranged in the transparent cover plate and electrically connected with the main control unit for sending a second touch control signal to the main control unit; and wherein, the main control unit is further configured to adjust a brightness of each of the first lamp strips and each of the second lamp strips after receiving the second touch control signal sent by the second touch control key.

9. The cabinet door according to claim 7, wherein the cabinet door further comprises:

a third touch control key arranged in the transparent cover plate and electrically connected with the main control unit for sending a third touch control signal to the main control unit;

wherein, the main control unit is further configured to adjust a color temperature of each of the first lamp strips and each of the second lamp strips after receiving the third touch control signal sent by the third touch control key.

10. The cabinet door according to claim 7, wherein the cabinet door further comprises:

a sensor electrically connected with the main control unit for detecting a human body in a preset range; and wherein, the main control unit is configured to turn on each of the first lamp strips and each of the second lamp strips when the sensor detects the human body.

11. A cabinet door, comprising:

a transparent cover plate;

an outer frame surrounding the transparent cover plate and secured with the transparent cover plate; and an inner frame arranged inside the outer frame, and used for supporting the transparent cover plate; wherein one side of the transparent cover plate faces the inner frame and the transparent cover plate comprises a reflecting region coated with a reflective coating and a light transmitting region surrounding the reflecting region, the light transmitting region comprises N light transmitting edges annularly arranged around the reflecting region, and a light transmitting corner is formed between any two adjacent light transmitting edges; wherein, the cabinet door comprises:

M first lamp strip corresponding to the N light transmitting edges; each of the first lamp strips is sequentially arranged along the inner frame, each of the first lamp strips is secured on the inner frame and is arranged on the same side as the respective light transmitting edge correspondingly, and each of the first lamp strips includes a first substrate that faces the outer frame and at least one first light source that emits light towards the corresponding light transmitting edge respectively when the cabinet door is opened;

K second lamp strips, wherein K is equal to M, each of the second lamp strips is secured on the inner frame, one second lamp strip is arranged between any two adjacent first lamp strips, each of the second lamp strips corresponds to the corresponding light transmitting corner respectively, and each of the second lamp strips includes a second substrate that faces the outer frame and at least one second light source that emits light towards the corresponding light transmitting corner respectively when the cabinet door is opened;

a main control unit electrically connected with each of the first lamp strips and each of the second lamp strips; and a first touch control key arranged in the transparent cover plate and electrically connected with the main control unit for sending a first touch control signal to the main control unit;

wherein, the main control unit is configured to turn on or turn off each of the first lamp strips and each of the second lamp strips after receiving the first touch control signal sent by the first touch control key.

12. The cabinet door according to claim 11, wherein the inner frame comprises:

a plurality of inner edges with a number same as that of the light transmitting edges, wherein the inner edges correspond to the light transmitting edges one by one, each of the inner edges is arranged on the same side as the corresponding light transmitting edge;

a plurality of corner edges with a number same as that of the light transmitting corners, one corner edge is arranged between any two adjacent inner edges, the corner edges correspond to the light transmitting corners one by one, and a normal direction of each of the corner edges points to the corresponding light transmitting corner respectively; and a plurality of enclosing edges, wherein at least two enclosing edges are respectively arranged at top parts of any two inner edges opposite to each other for supporting the transparent cover plate;

wherein, one first lamp strip is provided on one side of each of the inner edges facing the outer frame, and one second lamp strip is provided on one side of each of the corner edges facing the outer frame.

13. The cabinet door according to claim 12, wherein the first lamp strip comprises:

a first substrate secured on one side of any of the inner edges facing the outer frame; and a plurality of first light sources arranged on the first substrate.

14. The cabinet door according to claim 12, wherein the second lamp strip comprises:

a second substrate secured on one side of any of the corner edges facing the outer frame; and a plurality of second light sources arranged on the second substrate.

15. The cabinet door according to claim 11, wherein the cabinet door further comprises:

a second touch control key arranged in the transparent cover plate and electrically connected with the main control unit for sending a second touch control signal to the main control unit; and wherein, the main control unit is further configured to adjust a brightness of each of the first lamp strips and each of the second lamp strips after receiving the second touch control signal sent by the second touch control key.

16. The cabinet door according to claim 11, wherein the cabinet door further comprises:

a third touch control key arranged in the transparent cover plate and electrically connected with the main control unit for sending a third touch control signal to the main control unit;

wherein, the main control unit is further configured to adjust a color temperature of each of the first lamp strips and each of the second lamp strips after receiving the third touch control signal sent by the third touch control key.

17. The cabinet door according to claim 11, wherein the cabinet door further comprises:

a sensor electrically connected with the main control unit for detecting a human body in a preset range; and wherein, the main control unit is configured to turn on each of the first lamp strips and each of the second lamp strips when the sensor detects the human body.

18. A method for illumination of a cabinet door including an outer frame and an inner frame arranged inside the outer frame, the method comprising:

receiving a first touch control signal from a first touch control key;

generating a lamp strip control signal in response to the first touch control signal;

illuminating a first lamp strip and a second lamp strip in a light transmitting region of a transparent cover plate in response to the lamp strip control signal, wherein the light transmitting region of the transparent cover plate comprises light transmitting edges annularly arranged and a light transmitting corner is formed between any two adjacent light transmitting edges; the first lamp strip corresponds to the light transmitting edges and is sequentially arranged along the inner frame and secured on the inner frame and arranged on the same side as the respective light transmitting edge for emitting lights towards the corresponding light transmitting edge respectively when the cabinet door is opened, wherein the second lamp strip is secured on the inner frame, one second lamp strip is arranged between any two adjacent first lamp strips, each of the second lamp strips corresponds to the corresponding light transmitting corner respectively, and each of the second lamp strips is used for emitting lights towards the corresponding light transmitting corner respectively when the cabinet door is opened.

19. The method of claim 18, further comprising:

receiving a second touch control signal from a second touch control key;

adjusting a brightness of each of the second lamp strips in response to the second touch control signal sent by the second touch control key.

20. The method of claim 18, further comprising:

receiving a third touch control signal from a third touch control key;

adjusting a color temperature of each of the second lamp strips after receiving the third touch control signal sent by the third touch control key.

* * * * *